US008127964B2

(12) United States Patent
Barber

(10) Patent No.: US 8,127,964 B2
(45) Date of Patent: Mar. 6, 2012

(54) CONTAINER APPARATUS

(75) Inventor: Michael Barber, Williams, IN (US)

(73) Assignee: M. J. Barber, Inc., Williams, IN (US)

( * ) Notice: Subject to any disclaimer, the term of this patent is extended or adjusted under 35 U.S.C. 154(b) by 831 days.

(21) Appl. No.: 12/238,936

(22) Filed: Sep. 26, 2008

(65) Prior Publication Data

US 2009/0020533 A1 Jan. 22, 2009

Related U.S. Application Data

(63) Continuation-in-part of application No. 11/104,376, filed on Apr. 12, 2005, now abandoned.

(51) Int. Cl.
*B65D 67/00* (2006.01)
*B65D 65/10* (2006.01)

(52) U.S. Cl. ..... 220/495.06; 220/908; 428/100

(58) Field of Classification Search ..... 220/495.01, 220/495.05, 495.06, 495.08, 495.11, 908, 220/908.1, 751, 752, 756, 760
See application file for complete search history.

(56) References Cited

U.S. PATENT DOCUMENTS 1,647,169 A * 11/1927 Anton ..... 150/154
3,815,778 A 6/1974 Martin
3,968,626 A 7/1976 Hobbs
4,174,085 A 11/1979 Ferreira et al.
4,304,378 A 12/1981 Briggs
4,322,048 A 3/1982 Vollman
4,326,575 A 4/1982 Larkin
4,358,083 A 11/1982 Haubrich
4,376,520 A 3/1983 Wetherington
4,378,924 A 4/1983 Christensen
4,379,538 A 4/1983 Welles
4,488,697 A 12/1984 Garvey
4,537,377 A 8/1985 Shewchuk
4,728,070 A 3/1988 Engelbrecht
4,750,695 A 6/1988 Greenhouse
4,765,579 A 8/1988 Robbins, III et al.
4,946,118 A 8/1990 Hastings
5,014,943 A 5/1991 Nelson et al.
5,014,944 A 5/1991 Malik et al.
5,038,982 A 8/1991 Salveson
5,040,902 A 8/1991 Eaton et al.
5,100,087 A 3/1992 Ashby
5,139,219 A 8/1992 Navarro
5,318,821 A * 6/1994 Bradley, Jr. ..... 428/100
5,362,153 A 11/1994 Lu
5,456,431 A 10/1995 Ilnisky
D365,043 S * 12/1995 Bonds ..... D11/164
5,478,152 A 12/1995 Bogle
5,556,063 A 9/1996 Boyd
5,588,622 A 12/1996 Gordon, Sr.
5,597,208 A 1/1997 Bonutti (Continued)

*Primary Examiner* — J. Gregory Pickett
*Assistant Examiner* — Ernesto Grano
(74) *Attorney, Agent, or Firm* — Woodard, Emhardt, Moriarty, McNett & Henry LLP

(57) ABSTRACT

In certain embodiments, a container comprises a cylindrical fabric piece having first and second ends, a top cylindrical band attached to the fabric piece at or near the first end, and a bottom cylindrical band attached to the fabric piece at or near the second end. The container also includes a cylindrical body member having top and bottom circular ends. The bottom band is frictionally and concentrically positioned alongside the inner surface of the body member near the bottom end, the top band is frictionally and concentrically positioned alongside the inner surface of the body member near the top end, and the fabric piece extends along and covers the outer surface of the cylindrical body member.

11 Claims, 9 Drawing Sheets

U.S. PATENT DOCUMENTS 5,598,942 A * 2/1997 Cowie ..... 220/495.08
5,609,265 A * 3/1997 Haberkorn et al. ..... 220/694
5,775,722 A * 7/1998 Moore et al. ..... 280/727
5,899,419 A 5/1999 Ross et al.
5,938,094 A 8/1999 Forhan et al.
6,044,877 A * 4/2000 Bennet ..... 141/390
6,068,155 A * 5/2000 Sicherman ..... 220/495.06
6,108,974 A * 8/2000 Herzog-Mesrobian et al. .. 47/72
6,189,697 B1 * 2/2001 Davis ..... 206/581
6,895,611 B2 * 5/2005 Tharalson et al. ..... 5/99.1
7,252,207 B2 8/2007 Liao
2003/0160078 A1 8/2003 Godshaw et al.

* cited by examiner

CONTAINER APPARATUS

CROSS-REFERENCE TO RELATED APPLICATIONS

This application is a continuation-in-part of Application No. 11/104,376, filed Apr. 12, 2005now abandoned, which is hereby incorporated by reference in its entirety.

FIELD OF THE DISCLOSURE

The present invention relates generally to containers and more particularly to unique methods of forming containers and the resulting container apparatuses.

BACKGROUND OF THE DISCLOSURE

Waste containers, along with a variety of other types of containers, often prove unsatisfactory for a number of reasons. Specifically, many prior art waste containers are unattractive, not sturdy, not well-built, and/or not functional.

In many cases involving automobile "litter bags", a retail store plastic bag serves as the container that is used to collect trash. In addition to the overall unattractiveness of the bag, which must be placed in an easily seen location to be available when needed, it is often difficult to find a location that is convenient for use, does not interfere with or block the vehicle's controls, and allows the bag to remain open for easy deposit of trash. Plastic bags have a tendency to slump at their openings, therefore making it difficult to insert trash or garbage, to prevent trash from falling out of the bag, and to determine when the bag is full and ready to be discarded. The lack of a freestanding ability in such a bag is even more unsatisfactory in a home or office.

More permanent litter bags or trash containers are available, but residue is often left in the bag or container after it is emptied, necessitating periodically washing or otherwise cleaning of the bag or container. In addition to often not hanging properly or being inconveniently located in a vehicle environment, such bags are typically limited in size, and therefore require frequent emptying and/or cleaning.

There is a need for decorative, aesthetically-pleasing, as well as sturdy and well-built containers useful for a variety of different purposes.

SUMMARY OF DISCLOSURE

In certain embodiments, a container comprises a cylindrical fabric piece having first and second ends and a top cylindrical band having an attachment end and a free end, wherein the attachment end of the top band is circumferentially attached to the fabric piece at or near the first end. The container includes a bottom cylindrical band circumferentially attached to the fabric piece at or near the second end, wherein the top and bottom bands are composed of a pliable and rigid material. The container also includes a cylindrical body member having top and bottom circular ends defining top and bottom openings, respectively, inner and outer cylindrical surfaces, and an internal cylindrical cavity in communication with the top and bottom openings. The bottom band is frictionally and concentrically positioned alongside the inner surface near the bottom end, the top band is frictionally and concentrically positioned alongside the inner surface near the top end, and the fabric piece extends along and covers the outer surface of the cylindrical body member and the top and bottom ends. Further, the attachment end is positioned closer to the bottom end of the cylindrical body than the free end, such that the fabric piece and the top band define a circumferential slot therebetween, the slot being dimensioned to receive and frictionally maintain a flexible liner in an open configuration.

In certain other embodiments, a container comprises a tubular fabric piece having opposite top and bottom ends, a bottom band circumferentially coupled to the fabric piece at or near the bottom end, and a tubular body having opposite top and bottom ends defining top and bottom openings, respectively, inner and outer surfaces, and an internal cavity. The bottom band is snugly positioned alongside the inner surface and attached to the tubular body, the bottom band being substantially aligned with the bottom end of the tubular body. Additionally, the top end of the fabric piece is positioned within the internal cavity near the top end of the tabular body, and the fabric piece extends along and covers the outer surface and the top and bottom ends of the tubular body. The container further includes a bottom member coupled with the bottom band to close the bottom opening and prevent access to the internal cavity through the bottom opening.

In even other embodiments, a method for forming a container comprises the steps of forming a cylindrical piece of fabric having opposite first and second ends, providing first and second cylindrical bands, and circumferentially attaching the first and second bands adjacent the first and second ends, respectively. The method further includes turning the cylindrical piece of fabric inside-out, providing a cylindrical body having first and second opposite, circular ends defining first and second openings, respectively, inner and outer cylindrical surfaces, and an internal cavity, and positioning the first band within the internal cavity alongside the inner surface and substantially aligned with the first end. Additionally, the method includes attaching the first band to the cylindrical body, pulling the cylindrical piece of fabric along the outer surface so that the piece of fabric covers the first end and the outer surface of the cylindrical body, and tucking the second band into the internal cavity alongside the inner surface.

In yet other embodiments, a container comprises a cylindrical fabric piece having first and second ends, a top cylindrical band having an attachment end and a free end, wherein the attachment end of the top band is circumferentially attached to the fabric piece at or near the first end, and a bottom cylindrical band circumferentially attached to the fabric piece at or near the second end, wherein the top and bottom bands are composed at least in part of a pliable and rigid material. The container further includes a body member having a cylindrical portion and a bottom portion, wherein the cylindrical portion includes a top circular end defining a top opening, inner and outer cylindrical surfaces, and an internal cylindrical cavity in communication with the top opening. The bottom band is concentrically positioned alongside the outer surface of the cylindrical portion, the top band is concentrically positioned alongside the inner surface near the top end, and the fabric piece extends along and substantially covers the outer surface of the cylindrical portion and the top end.

Further objects, embodiments, forms, benefits, aspects, features and advantages of the present disclosure may be obtained from the description, drawings, and claims provided herein.

DETAILED DESCRIPTION OF THE VARIOUS EMBODIMENTS

Figure 1:
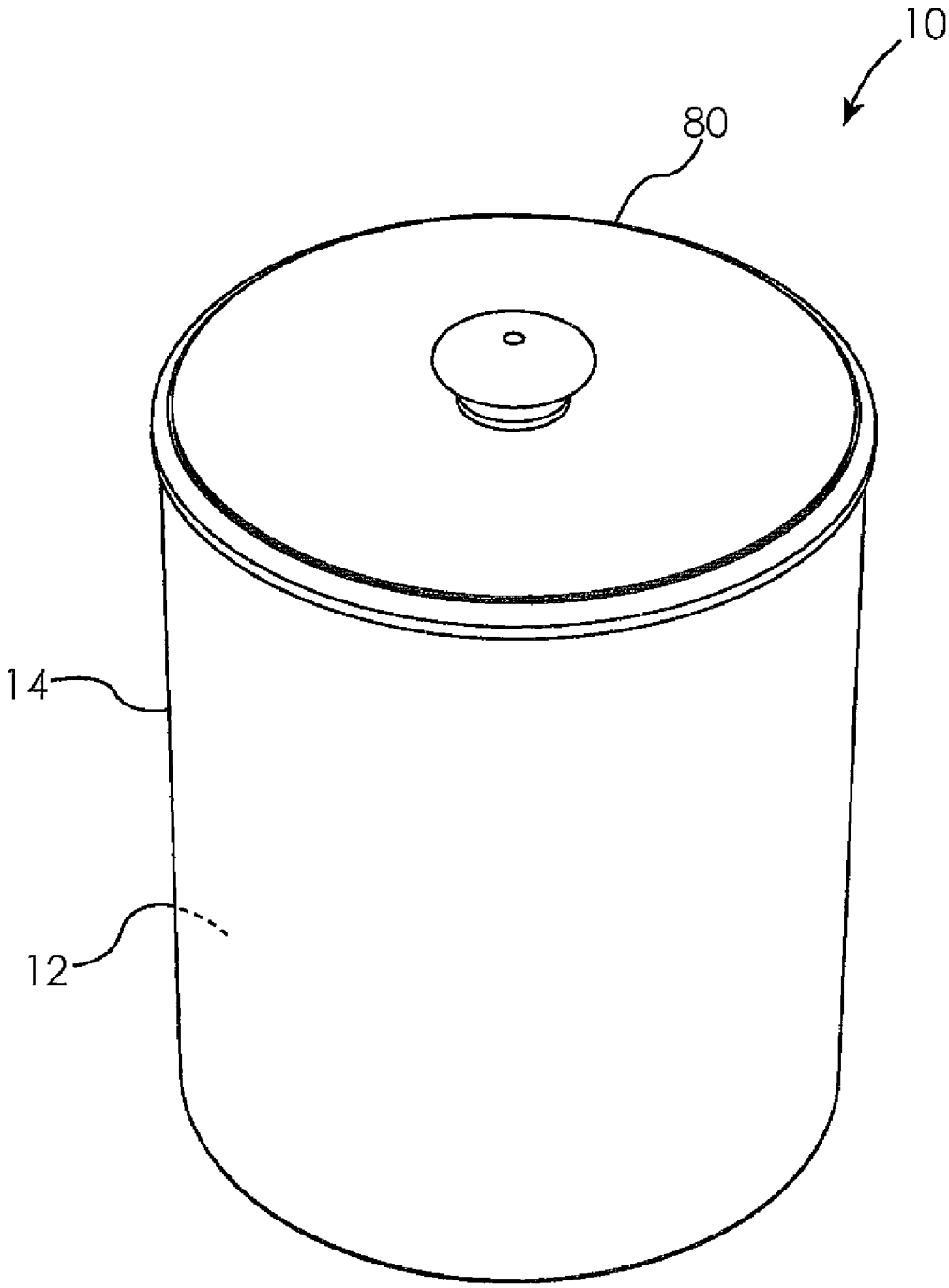
FIG. 1 is a perspective view of a container according to an embodiment of the present disclosure.
Figure 2:
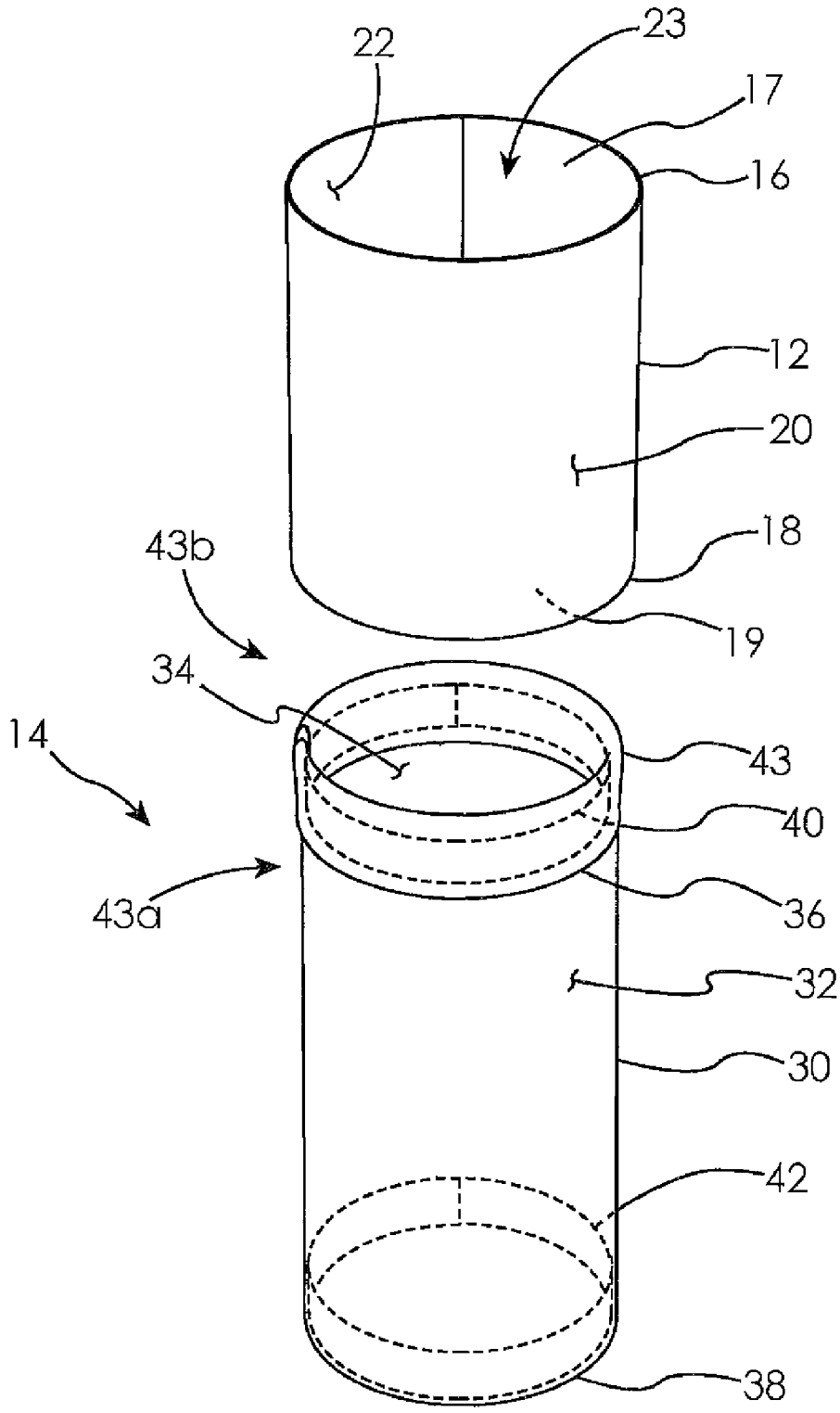
FIG. 2 is a perspective, exploded view of components of a container according to an embodiment of the present disclosure.

For the purposes of promoting understanding of the principles of the disclosure, reference will now be made to the embodiments illustrated in the drawings and specific language will be used to describe the same. It will nevertheless be understood that no limitation of the scope of the disclosure is hereby intended and alterations and modifications in the illustrated device, and further applications of the principles of the present disclosure as illustrated herein being contemplated as would normally occur to one skilled in the art to which the disclosure relates.

In certain embodiments, the present disclosure generally relates to unique containers and methods for forming such containers. The containers include tubular, rigid body members having fabric covers surrounding the outer surfaces of the body members. Additionally, the covers include top and bottom rigid bands configured to tuck inside the body members at the tops and bottoms thereof to snugly hold the cover in place. The containers may also include bottom members engaging the bottom bands to provide a floor to the container. Optionally, the containers may include lids to close the top openings of the body members. The containers may take a variety of different shapes, such as rectangular, cylindrical, oval and square, just to name a few non-limiting examples. Additionally, the containers may be used for a variety of different purposes, such as trash cans, toy chests, clothing chests, facial tissue box enclosures and magazine bins, just to name a few non-limiting examples.

Figure 3:
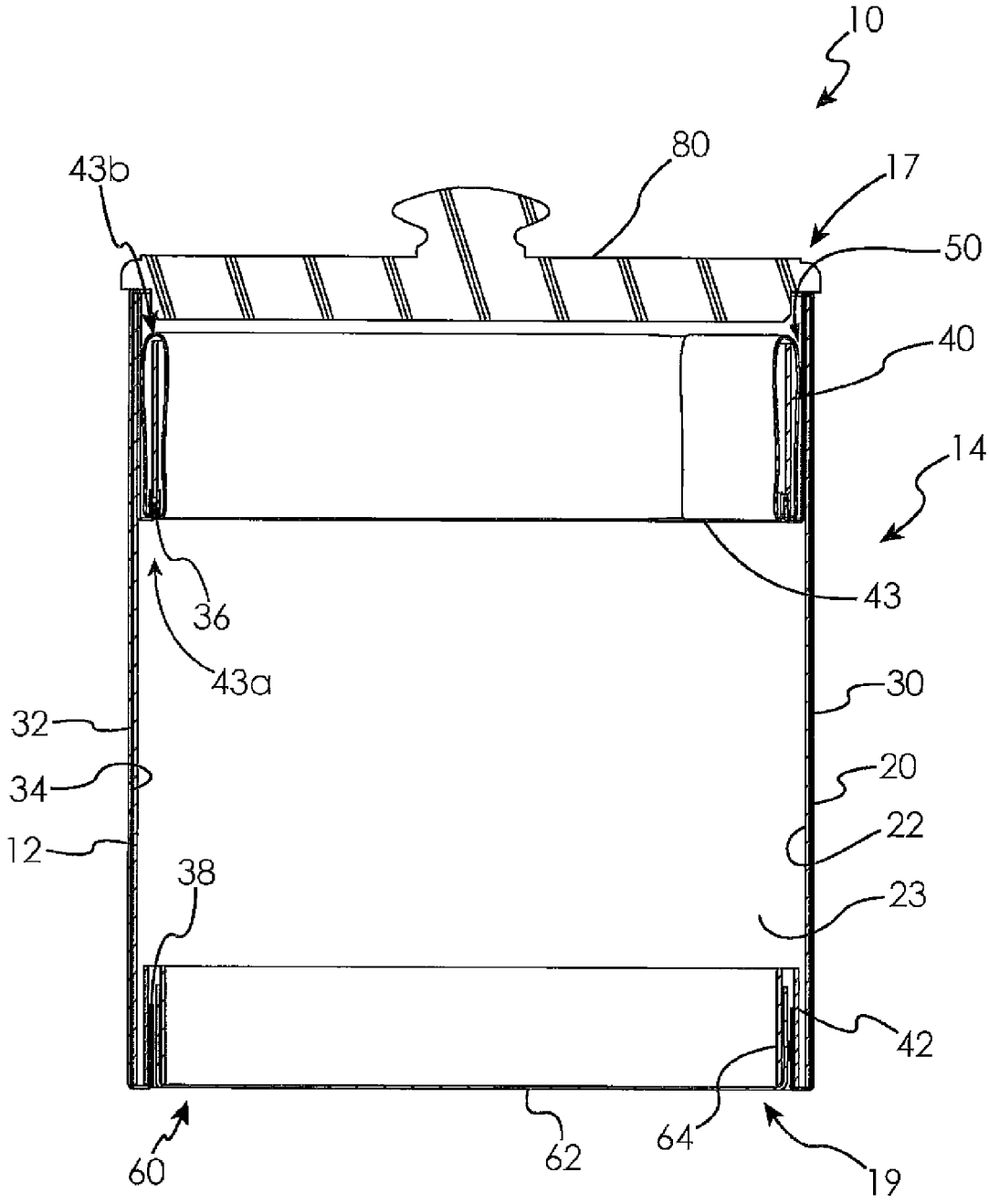
FIG. 3 is a cross-sectional view of a container according to an embodiment of the present disclosure.

FIGS. 1-8 generally illustrate example embodiments of a container according to the present disclosure. As illustrated in the figures, container 10 includes a cylindrical body member 12 and a cylindrical fabric cover 14. Body member 12 includes a top end 16 defining a top opening 17, a bottom end 18 defining a bottom opening 19, an outer cylindrical surface 20 and an inner cylindrical surface 22 defining an internal cavity 23 in communication with top and bottom openings 17 and 19. Cover 14 includes a cylindrical fabric piece 30 having an outer decorative surface 32, an inner surface 34, a top end 36 and a bottom end 38. Cover 14 additionally includes a top cylindrical band 40 coupled with the top end 36 of fabric piece 30 and a bottom cylindrical band 42 coupled with the bottom end 38 of fabric piece 30. As best illustrated in FIG. 3, the bands 40 and 42 tuck inside the body member 12 into the internal cavity 23 adjacent top and bottom ends 16 and 18, respectively. The bands 40 and 42 tuck inside such that they are snugly, frictionally, and/or tightly positioned against or alongside inner surface 22 in a concentric arrangement (see FIG. 3). Although one or more layers of material or fabric may be sandwiched between the bands and the inner surface 22, for the purposes of the present disclosure the bands will be referred to as being positioned alongside or against the inner surface 22. In this way, the fabric piece 30 is pulled tightly across the outer surface 20 (as well as top and bottom ends 16 and 18) of body member 12, with the outer decorative surface 32 facing outward from the body member 12 to provide a pleasing, decorative appearance to the container 10. The decorative surface 32 of the fabric piece 30 may be selected to match the particular environment in which the container 10 will be used and can be provided in a variety of colors and patterns. Additionally, the fabric piece 30 may be cloth, leather, vinyl, plastic or a variety of other appropriate materials as desired.

In the illustrated embodiment, body member 12 is cylindrical in shape. However, it should be appreciated that body member 12 can be shaped otherwise as would occur to one of ordinary skill in the art. As alternative examples, body member 12 could be square or rectangular in cross-sectional shape. The body member 12 may be composed of a variety of different materials. In certain embodiments, body member 12 is composed of a substantially rigid material such that body member 12 maintains its general shape, yet sufficiently flexible such that body member 12 may be manipulated as desired. As one example, body member 12 may be composed of a plastic material, such as polyethylene.

Additionally, top and bottom bands 40 and 42 are illustrated as being annular and cylindrical in shape. However, it should be appreciated that in other embodiments bands 40 and 42 may be shaped otherwise as would occur to one of ordinary skill in the art. The bands 40 and 42 may also be composed of a variety of different materials. In certain embodiments, bands 40 and 42 are composed of a strong and substantially rigid material such that the bands are able to maintain their general shape, yet sufficiently flexible or pliable such that bands may be manipulated as desired. As one example, bands 40 and 42 may be composed of a plastic material, such as polyethylene. Optionally, top band 40 may be surrounded by a sleeve 43. For the purposes of the present disclosure, referring to the "top band" in certain situations may include reference to the combination of the top band 40 and the outer sleeve 43. Sleeve 43 may be composed of a softer, more flexible material than the band 40. As one non-limiting example, sleeve 43 may be composed of a plastic material, such as vinyl. As illustrated, bands 40 and 42 may be relatively thin, flat bands having a substantially rectangular cross-sectional shape. In certain embodiments, the height of the bands may be about 2 inches, or greater than 2 inches, and the width may be less than $1/8^{th}$ of an inch, or about $1/16^{th}$ of an inch in a particular embodiment. As illustrated, the bands 40 and 42 may each be configured with an overall diameter slightly smaller than the diameter of the body member 12 to enable the snug, frictional fit (see FIGS. 3 and 6).

Figure 8:
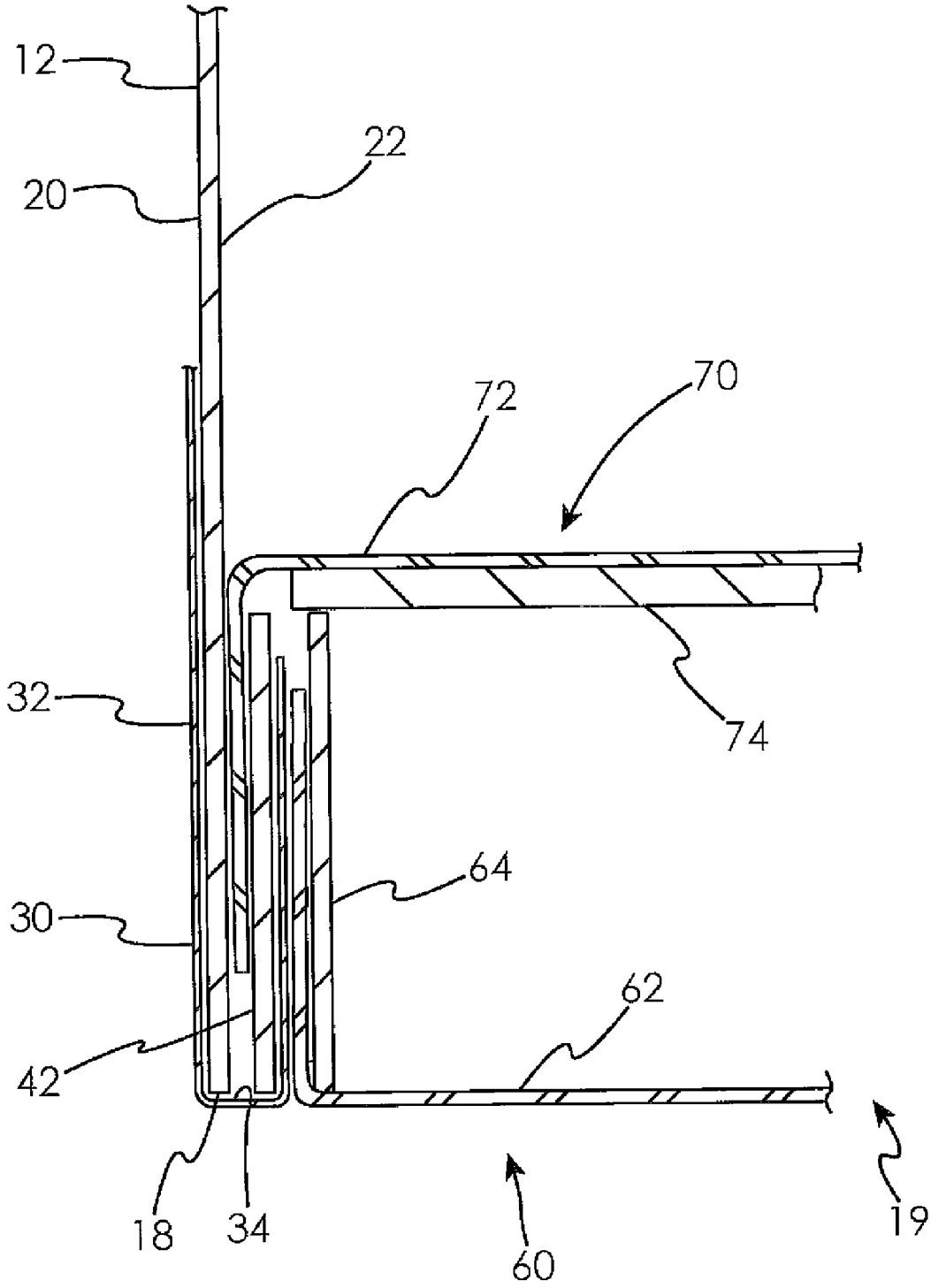
FIG. 8 is a close-up cross-sectional view of components of a container according to an embodiment of the present disclosure.

In particular embodiments, sleeve 43 and band 42 may be sewn to (or near) the ends 36 and 38, respectively, of fabric piece 30. However, it should be appreciated that sleeve 43 and band 42 may be attached to or coupled with fabric 30 in a variety of other possible manners as would occur to one skilled in the art. In embodiments in which sleeve 43 is absent, top band 40 is directly attached to or coupled with the top end 36 of the fabric piece 30. The bands 40 and 42 may be snuggly positioned within the internal cavity 23 against or alongside inner surface 22 (if sleeve 43 is present, sleeve 43 is positioned alongside inner surface 22 between band 40 and surface 22), and remain positioned therein via interference fit. In certain embodiments, the bottom band 42 is aligned with or positioned substantially adjacent bottom end 18. One or both of the bands may also be attached to the body member 12 through the use of one or more fasteners to secure the positioning of the band(s). In a particular example embodiment, bottom band 42 may be stapled to body member 12 to ensure that bottom band 42 remains positioned at the desired location. It should also be understood that, for clarity, FIGS. 4 and 8 show gaps between some of the components to best illustrate the positions thereof; however, it should be appreciated that in some embodiments, the components are positioned directly next to and in a touching relationship with the adjacent components.

Figure 4:
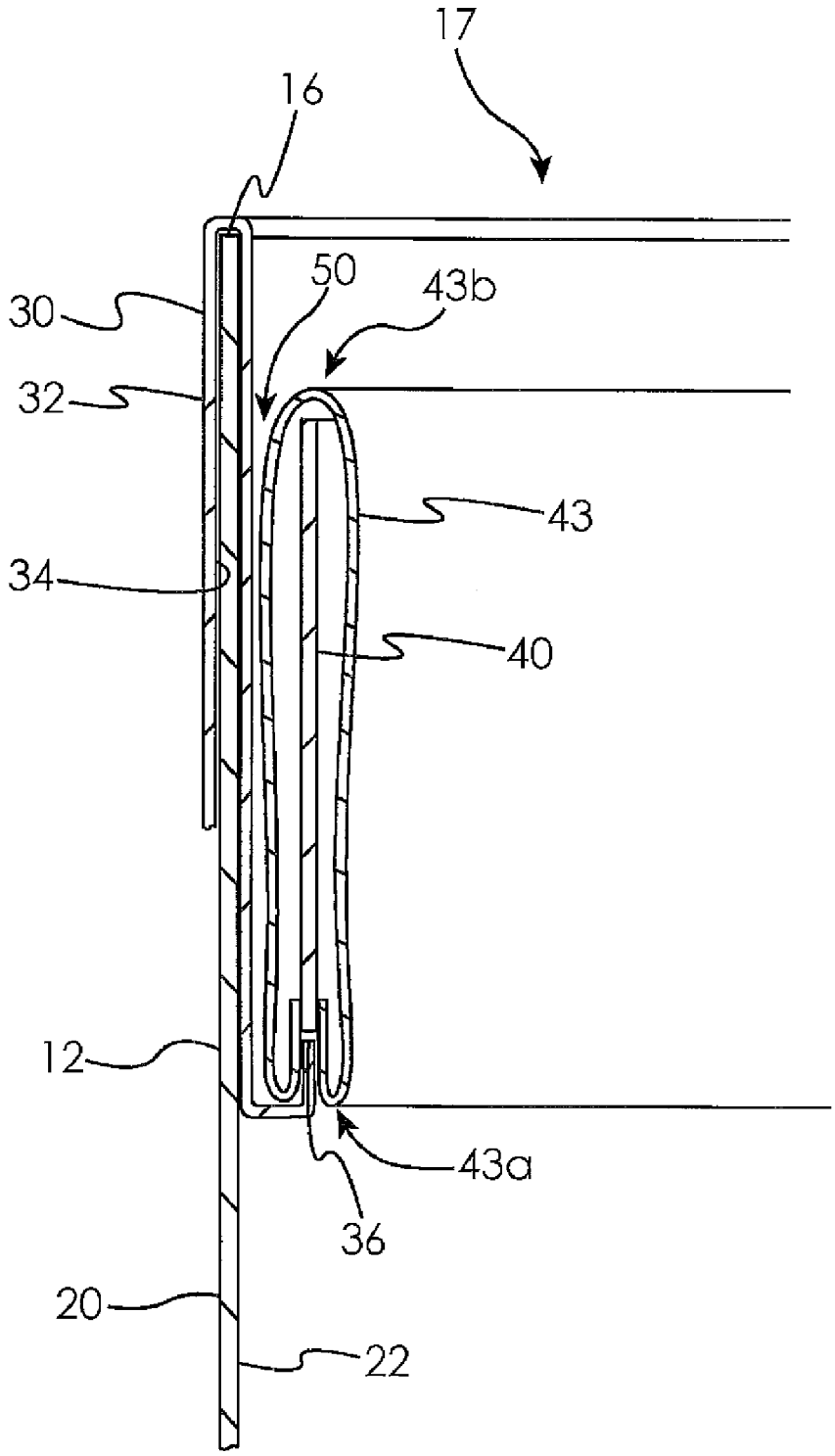
FIG. 4 is a close-up cross-sectional view of components of a container according to an embodiment of the present disclosure.
Figure 5:
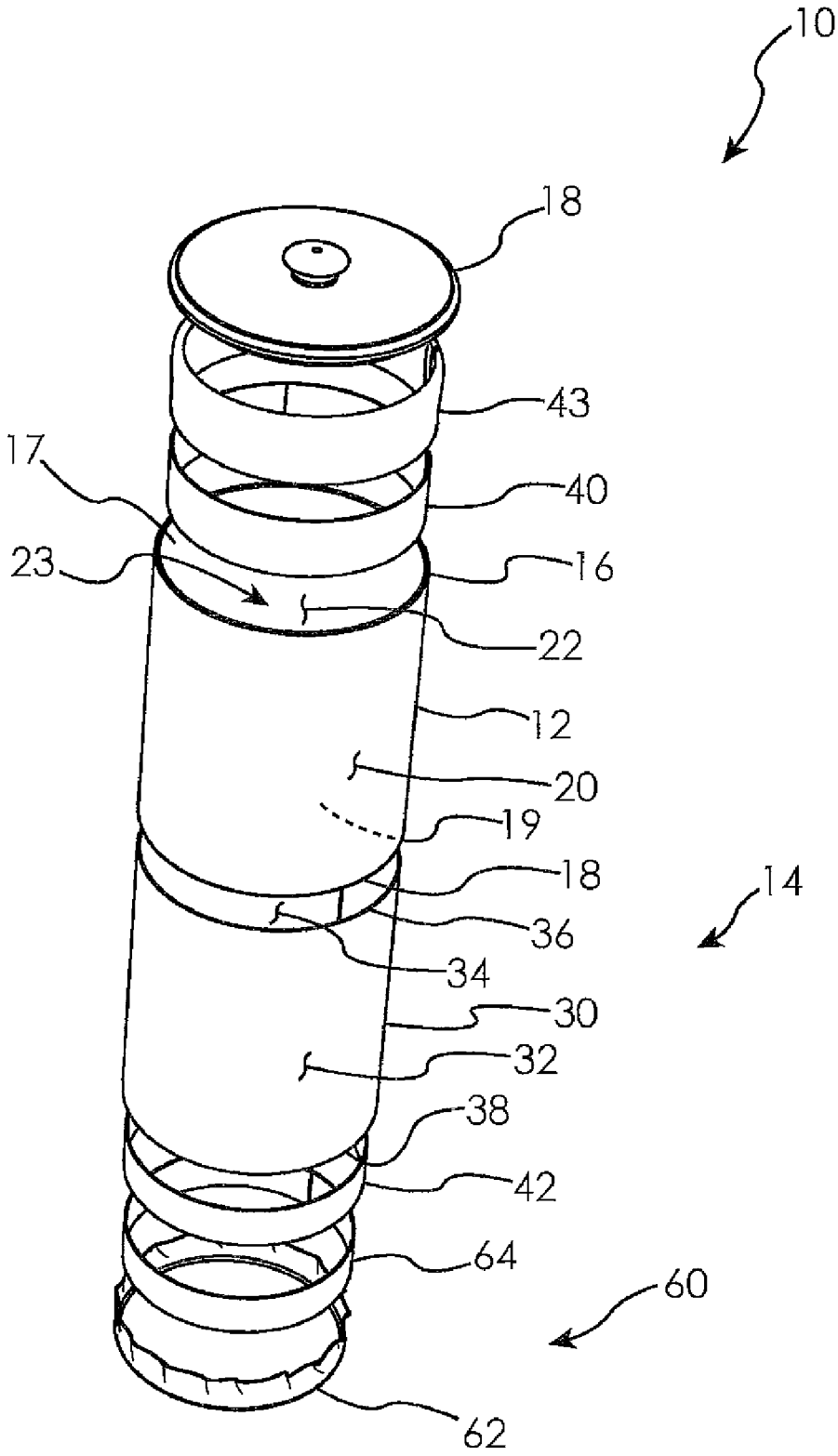
FIG. 5 is a perspective, exploded view of components of a container according to an embodiment of the present disclosure.

As illustrated, sleeve 43 includes an attachment end 43*a* adjacent top end 36 of fabric piece 30 and an opposite free end 43*b* (see FIG. 4). In certain embodiments, sleeve 43 containing band 40 is tucked into internal cavity 23 with attachment end 43*a* facing down toward bottom end 18 of body member 12. As such, a circumferential slot 50 will be created or defined between fabric piece 30 and sleeve 43. In embodiments in which sleeve 43 is absent, circumferential slot 50 is defined between fabric piece 30 and top band 40. A liner, such as a conventional plastic garbage bag as an example, may be tacked into the circumferential slot 50 for receiving trash and refuse. The liner is firmly held in position, yet is easily removed and replaced when full. In certain embodiments, a tool may be used to insert the top portion of the liner into the slot 50. In alternative embodiments, slot 50 is absent.

Container 10 may optionally include a bottom, floor, or base to the container to close off bottom opening 19. In alternative embodiments, container 10 may be tubular in configuration, with top and bottom openings 17 and 19 remaining open. A bottom, floor, or base to the container 10 may be configured, arranged, and assembled in a variety of possible ways. Non-limiting examples are illustrated in at least FIGS. 3 and 6.

Turning to the example shown in FIG. 3, the illustrated container 10 includes a bottom 60 comprised of a material piece 62 held in a taut position by a third cylindrical band 64. As illustrated, a section at or near the perimeter of material piece 62 may be held taut between third band 64 and bottom band 42, with the bands being substantially aligned and concentrically positioned. Additionally, third band 64 is configured to fit snugly and concentrically within bottom band 42 via interference fit. Third band 64 may optionally be attached to bottom band 42, such as by sewing or through the use of one or more fasteners. In the illustrated embodiment, the piece 62 is circular in shape and includes a diameter larger than the diameter of third band 64, such that the extra material is held in position between bands 64 and 42. However, it should be appreciated that the material piece 62 may be shaped and configured otherwise as would generally occur to one skilled in the art. Additionally, the piece 62 may be made from a variety of appropriate materials. In certain embodiments, piece 62 may be the same material as fabric piece 30. In other embodiments, material piece 62 may be the same material as sleeve 43. In a particular example embodiment, material piece 62 may be a plastic material, such as vinyl as one non-limiting example.

Figure 6:
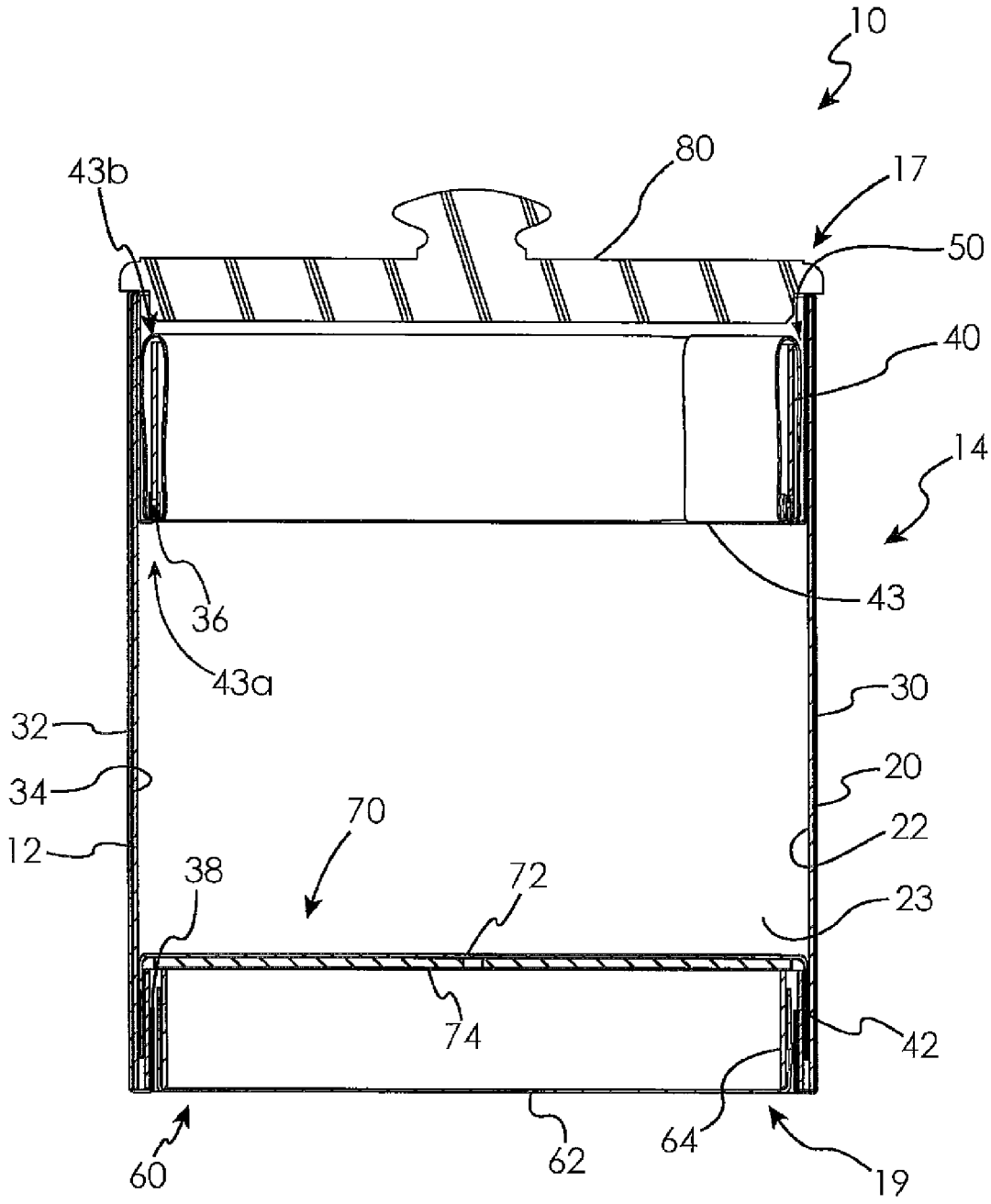
FIG. 6 is a cross-sectional view of a container according to an embodiment of the present disclosure.
Figure 7:
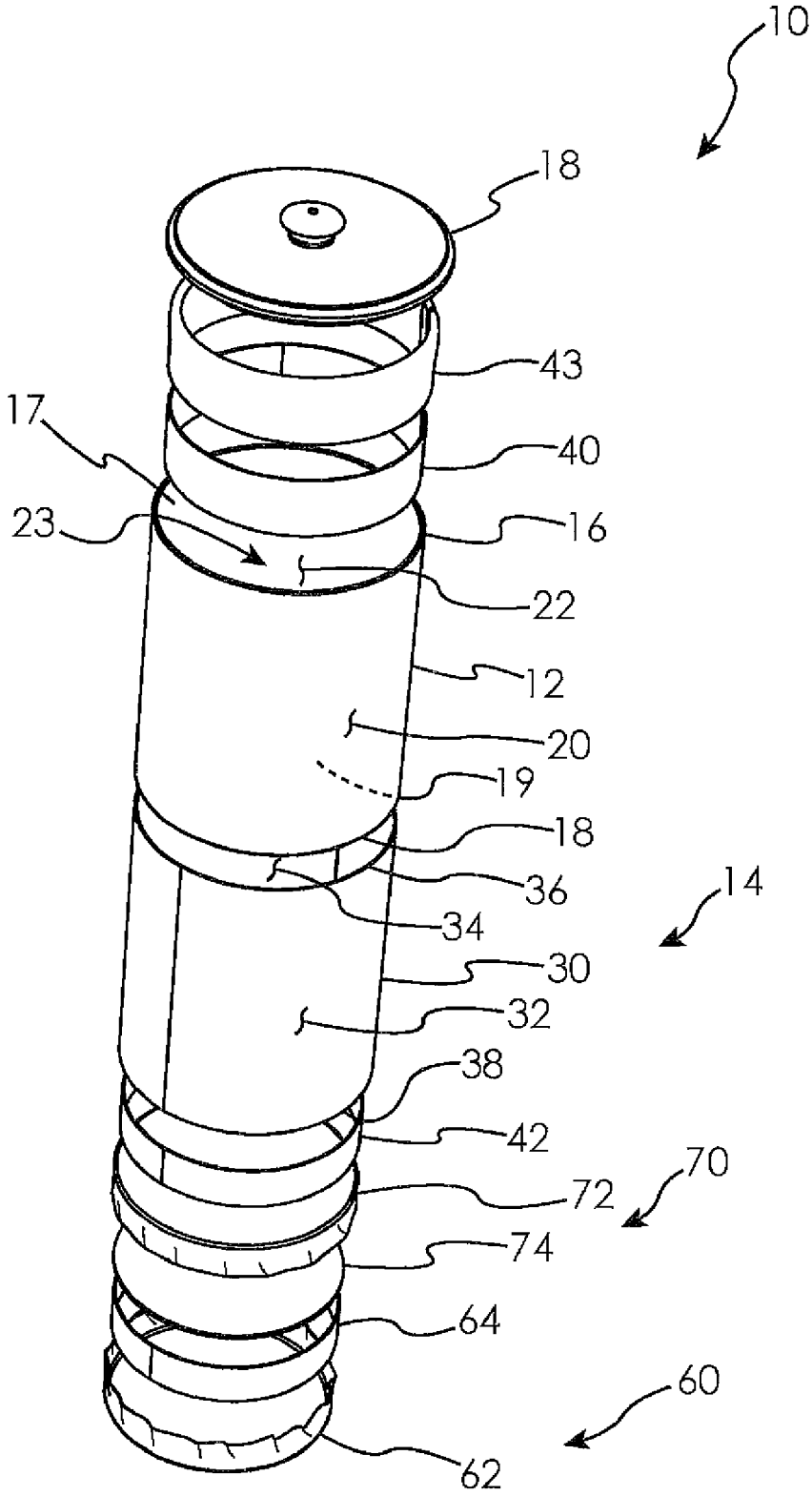
FIG. 7 is a perspective, exploded view of components of a container according to an embodiment of the present disclosure.

In certain embodiments, container 10 may include a more rigid and sturdy floor in addition to or in lieu of the bottom 60 (including the material piece 62/third band 64 combination). As illustrated in FIG. 6, container 10 may also optionally include a rigid floor 70. Rigid floor 70 may be comprised of a variety of appropriate rigid components and may be arranged in a variety of possible manners as would occur to one skilled in the art, with the specific example illustrated in FIG. 6 being just one non-limiting example. In the particular illustrated embodiment, floor 70 includes a material piece 72 covering a rigid piece 74. Material piece 72 is held snugly and taut between bottom band 42 and inner surface 22 of body member 12. Additionally, rigid piece 72 is sized and configured to fit snugly within internal cavity 23 and extend substantially across the cross-sectional area of body member 12. Rigid piece 72 may rest on at least bottom band 42, as illustrated, or may be otherwise attached to or coupled with one or more other components of container 10. In alternative embodiments, rigid piece 72 may be associated with bottom 60, with the rigid piece being held against the edges of third band 64 by material piece 62 and the material piece 72 being absent. The material piece 72 and the rigid piece 74 may be composed of a variety of appropriate materials as would generally occur to one skilled in the art. Additionally, the pieces 72 and 74 are illustrated as circular, but may be shaped and configured otherwise as would generally occur to one skilled in the art.

In certain embodiments, the rigid floor of the container may be a rigid base (not shown) aligned with and extending within bottom band 42, with material pieces 62 and 72, third band 64, and rigid piece 74 being absent. In certain embodiments, the rigid base may be attached to bottom band 42 through the use of one or more fasteners, such as staples, screws or bolts, as non-limiting examples. The rigid base may be sized, shape and configured in a variety of manners, so long as the base substantially extends the area within bottom band 42. Additionally, the rigid base may be composed of a variety of materials, with wood being one non-limiting example.

Optionally, container 10 may include a lid 80 to selectively close off top opening 17. The lid may be selectively opened and closed to allow selective access to internal cavity 23. Additionally, the lid may be separate and completely removable from body member 12. In other embodiments, the lid may be movably engaged with body member 12 (or top band 40) in a variety of possible manners, such as via a hinged arrangement as one non-limiting example.

Further, the container 10 may optionally include attachment means for mounting or attaching the container 10 within the environment in which the container will be used. As non-limiting examples, the attachment means may include hooks, elastic straps, or handles of different types. The attachment means may be engaged with container 10 in a variety of appropriate manners as would generally occur to one of ordinary skill in the art.

The containers according to the present disclosure may be formed in different shapes and sizes as would generally occur to one of ordinary skill in the art. In certain embodiments, the containers may be larger in size and may be configured as toy chests, clothes chests, clothes hampers, or large trash bins, just to name a few non-limiting examples. In other embodiments, the containers may be smaller in size and may be configured as small trash bins, magazine bins, facial tissue box enclosures, bathroom tissue holders, and food containers, just to name a few non-limiting examples.

Although the illustrated containers are cylindrical in shape, with circular cross-sections, it should be appreciated that the containers according to the present disclosure may occupy a variety of different shapes as would generally occur to one skilled in the art. In certain embodiments, the containers may have oval, square or rectangular cross-sectional shapes. The pliable or flexible nature of the body member and the bands allows for the containers to assume different shapes. In embodiments in which a rigid base member is used, the engagement of the lower band with the rigid base member and the engagement of the body member with the lower band allows the container to take on the same cross-sectional shape as the rigid base member. As an example, if a rectangular piece of wood is used as the rigid base member, the lower band will be attached to the perimeter of the rectangular piece of wood and will thereby assume a rectangular shape as a result of the pliable nature of the band. The engagement of the body member with the now rectangular lower band will allow the container body to also assume a rectangular cross-sectional shape given the pliable nature of the body member.

A method or process for forming the example container 10 illustrated in FIG. 3 will now be described in greater detail. It should be appreciated that a similar method or process for forming other containers in accordance with the present disclosure are contemplated by the present disclosure. In certain embodiments, a user provides a fabric piece 30 of a desired decoration and a desired shape and size by cutting or otherwise. The fabric piece 30 may be sewn or otherwise attached along opposite ends thereof to form a cylindrical shape. Once the desired size of top and bottom bands 40 and 42 is achieved, the bands can be formed into a cylindrical shape through suitable attachment means, such as by sewing, through the use of adhesive, or through the use of fasteners. Bottom band 42 and sleeve 43 may be sewn to bottom end 38 and top end 36, respectively, of the fabric piece 30 before or after the fabric piece 30 is formed into a cylindrical shape. Top band 40 is inserted into sleeve 43 to provide rigidity to the top of the fabric piece 30. Thereafter, the fabric 30 is turned inside-out such that the decorative surface 32 faces inward.

Optionally, a user may insert a third band 64 within bottom band 42 in a concentric arrangement, sandwiching or tucking material piece 62 between the bands such that material piece 62 is held taut between the bands. In certain embodiments, third band 64 is inserted within bottom band 42 using a number of possible techniques, such as by hand or through the use of a tool or machine so that the third band 64 is substantially aligned with bottom band 42. A user may then insert bottom band 42 through the bottom opening 19 of body member 12 into internal cavity 23 and position the bottom band 42 alongside inner surface 22 adjacent and aligned with bottom end 18. The bottom band 42 (along with third band 64) may be inserted and positioned as desired by hand or through the use of a tool or machine to substantially align the bottom edges of the components. As mentioned above, the bottom band 42 may optionally be attached to the body member 12 through the use of fasteners, adhesive or otherwise, or may remain positioned via interference fit. The fabric piece 30 is then pulled toward top end 16 of body member 12 such that the fabric covers and extends across outer surface 20 of body member 12 with the decorative surface 32 facing outward from the container. The fabric piece 30 is preferably pulled tight to remove any puckers or excess fabric. The sleeve 43 is tucked into internal cavity 23 through top opening 17 with the attachment end 43*a* facing down toward bottom end 18. In this way, circumferential slot 50 is formed so that a liner may be tucked into the slot to be held in an open configuration. The optional lid 80 may be selectively engaged with body member 12 as desired.

Figure 9:
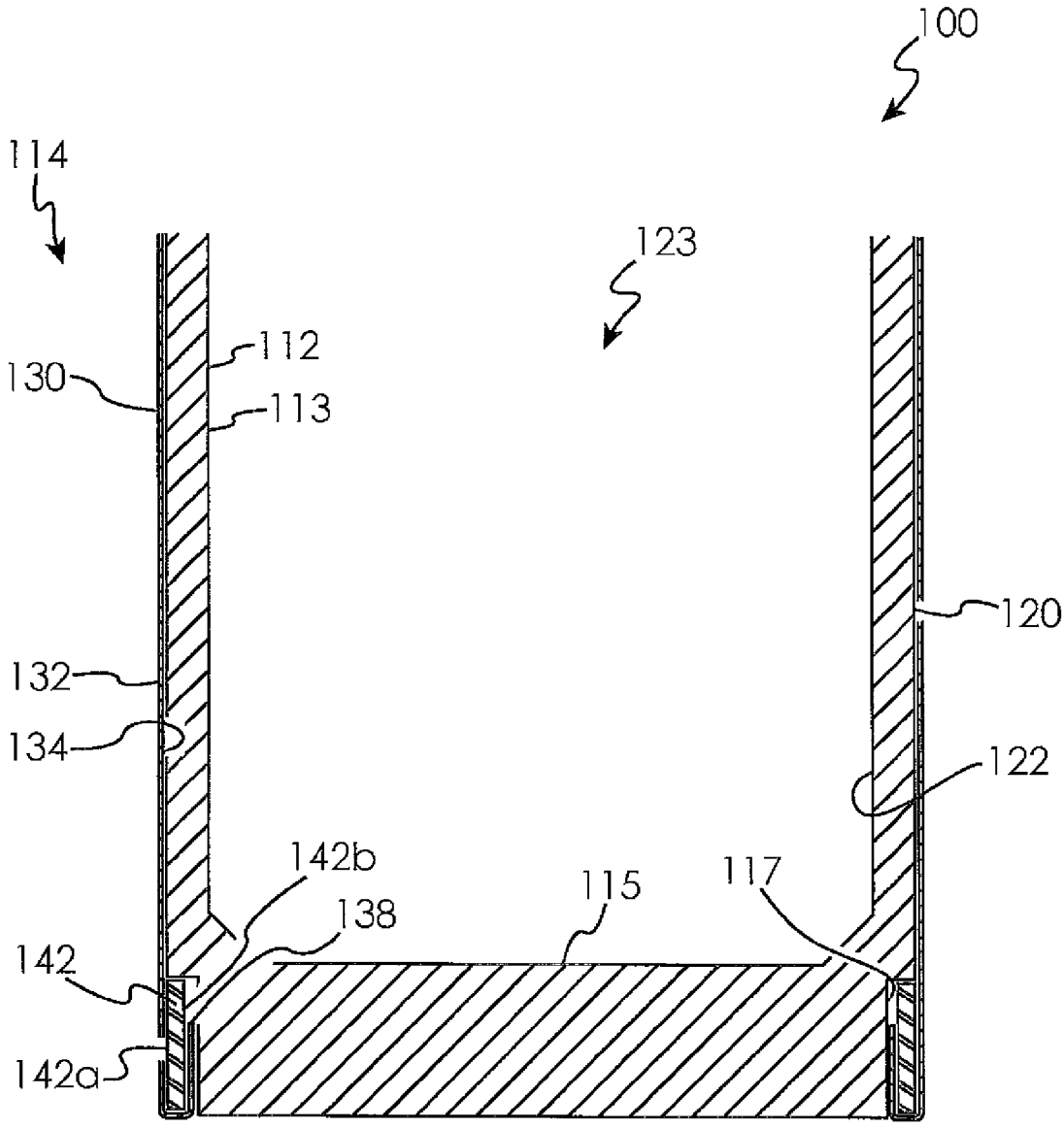
FIG. 9 is a close-up cross-sectional view of components of a container according to an embodiment of the present disclosure.

FIG. 9 illustrates an alternative embodiment container 100 in which a container body 112 includes both a cylindrical portion 113, similar to body member 12, and an integral bottom portion 115. For clarity, only the lower part of the container 100 is illustrated, as the upper part can be arranged and configured in many of the same or similar possible manners discussed above. Body 112 also includes an outer surface 120 and an inner surface 122 defining an internal cavity 123. In certain embodiments, container body 112 may be made from an injection molding process. However, it should be appreciated that body 112 can be formed via a variety of other possible manners as would occur to one of ordinary skill in the art. The fabric cover 112 for container body 112 includes a fabric piece 130 (having outer decorative surface 132 and an opposite inner surface 134) attached to a lower band 142 at near or bottom end 138 of piece 30 and an upper band (not shown) at or near the top end (not shown) of the fabric piece 30.

As illustrated, lower band 142 may be engaged with the container body 112 at or near the bottom thereof. As such, fabric piece 130 can be pulled up over the cylindrical portion 113 alongside outer surface 120 and engaged with the top of the container body. Optionally, one or more fasteners (not shown) may be used to secure the positioning of the lower band 142 with container body 112. The fasteners used in accordance with the present disclosure may be a variety of appropriate fasteners as would occur to one of ordinary skill in the art, including screws, bolts, staples, nails, and adhesive, as non-limiting examples. In the illustrated embodiment, container body 112 includes a circumferential notch 117 at the bottom thereof configured to receive lower band 142 therein, such that the lower band 142 is positioned substantially flush with outer surface 120 at cylindrical portion 113. In this way, fabric piece 130 may be pulled substantially straight up portion 113 to the top end of the container body. However, it should be appreciated that in other embodiments notch 117 may be absent or otherwise configured.

As with the embodiments discussed above, fabric piece 130 may be engaged with lower band 142 in a variety of possible ways, including by sewing as one non-limiting example. In the illustrated embodiment, an amount of fabric piece 130 is attached to or otherwise coupled with lower band 142 along inner side 142*b* of the lower band, such that the amount of fabric is sandwiched between lower band 142 and outer surface 120 upon assembly of the container. However, it should be appreciated that the fabric piece 130 may be engaged with lower band 142 in other arrangements so that more or less or none of the fabric piece 130 is positioned between lower band 142 and outer surface 120. Similar to the illustration of FIG. 8, FIG. 9 shows many of the components as being slightly spaced apart for clarity purposes. However, it should be appreciated that upon assembly of the container, many of the components positioned directly against each other as in a touching arrangement.

While the disclosure has been illustrated and described in detail in the drawings and foregoing description, the same is to be considered as illustrative and not restrictive in character, it being understood that only certain embodiments have been shown and described and that all changes, modifications and equivalents that come within the spirit of the disclosure are desired to be protected. The articles "a", "an", "said" and "the" are not limited to a singular element, and include one or more such elements.

What is claimed is:

1. A container, comprising:

a cylindrical fabric piece having first and second ends;

a top cylindrical band having an attachment end and a free end, wherein said attachment end of said top band is circumferentially attached to said fabric piece at or near said first end;

a bottom cylindrical band circumferentially attached to said fabric piece at or near said second end, wherein said top and bottom bands are composed at least in part of a pliable and rigid material; and a cylindrical body member having top and bottom circular ends defining top and bottom openings, respectively, inner and outer cylindrical surfaces, and an internal cylindrical cavity in communication with said top and bottom openings;

wherein said bottom band is frictionally and concentrically positioned alongside said inner surface near said bottom end, said top band is frictionally and concentrically positioned alongside said inner surface near said top end, and said fabric piece extends along and covers said outer surface of said cylindrical body member and said top and bottom ends;

wherein said attachment end is positioned closer to said bottom end of said cylindrical body than said free end, such that said fabric piece and said top band define a circumferential slot therebetween, said slot being dimensioned to receive and frictionally maintain a flexible liner in an open configuration.

2. The container of claim 1, wherein said bottom band is sewn to said fabric piece.

3. The container of claim 1, further comprising one or more fasteners attaching said bottom band to said cylindrical body member, wherein said top band remains positioned alongside said inner surface of said cylindrical body member via interference fit.

4. The container of claim 1, wherein said top and bottom bands are substantially rectangular in cross-sectional shape, each having a width and a height, wherein the height of each of said bands is at least two inches and wherein the width of said bottom band is less than one-eighth of an inch.

5. The container of claim 1, wherein said cylindrical body member and said bottom band are made of polyethylene.

6. The container of claim 1, wherein said top cylindrical band includes an outer flexible sleeve defining a central passageway configured to receive an inner rigid band, wherein said sleeve at least partially surrounds said inner rigid band and is sewn to said fabric piece at or near said first end.

7. The container of claim 6, wherein said inner rigid band is made of polyethylene and said outer sleeve is made of vinyl.

8. The container of claim 1, further comprising a lid configured to close said top opening.

9. The container of claim 1, further comprising a bottom member coupled with said bottom band to close said bottom opening and prevent access to said internal cavity through said bottom opening.

10. The container of claim 9, further comprising a third band frictionally and concentrically positioned alongside and within said bottom band, wherein said bottom member is a piece of material held taut between said bottom band and said third band.

11. The container of claim 1, further comprising a rigid floor member coupled with said bottom band to provide a rigid support surface for the contents placed in said internal cavity.

* * * * *